United States Patent [19]

Reaser

[11] Patent Number: 4,893,608

[45] Date of Patent: Jan. 16, 1990

[54] FURNACE ROOF JACK WITH PIVOTING FLASHING PLATE

[75] Inventor: Greg Reaser, Wichita, Kans.

[73] Assignee: Coleman Heating & Air Conditioning Products, Inc., Wichita, Kans.

[21] Appl. No.: 215,272

[22] Filed: Jul. 5, 1988

[51] Int. Cl.[4] ..... F24C 3/00

[52] U.S. Cl. ..... 126/85 B; 126/307 R; 126/314; 285/44; 98/62

[58] Field of Search ..... 126/314–319, 126/307 R, 312; 98/40.02, 62; 285/42–44

[56] References Cited

U.S. PATENT DOCUMENTS

| | | | |
|---|---|---|---|
| 302,373 | 7/1884 | Atkin | 126/314 |
| 460,424 | 9/1891 | Bidwell | 285/43 |
| 644,415 | 2/1900 | Folger | 285/44 |
| 807,794 | 12/1905 | Watson | 285/44 |
| 862,415 | 8/1907 | Rohrer | 285/43 |
| 885,318 | 4/1908 | Bullard | 285/44 |
| 1,174,763 | 3/1916 | Redlon | 285/44 |
| 1,202,687 | 10/1916 | Elkerton | 285/43 |
| 1,270,919 | 7/1918 | Berg | 285/43 |
| 1,704,942 | 3/1929 | Hopson | 285/44 |
| 3,398,671 | 8/1968 | Acosta | 126/307 R |
| 3,765,317 | 10/1973 | Lowe | 98/40.02 |

*Primary Examiner*—James C. Yeung

[57] ABSTRACT

A furnace roof jack is provided with a pivoting flashing plate which can be attached to pitched roofs having various pitch angles. The roof jack includes an elongated generally cylindrical tube. An enlarged portion of the tube has a generally spherical outer surface. A flashing plate is provided with a hole having a diameter approximately the same as the diameter of the spherical surface. The flashing plate is pivotally attached to the tube on an axis which extends perpendicularly to the axis of the tube along a diameter of the spherical surface.

9 Claims, 4 Drawing Sheets

FIG. 1
PRIOR
ART
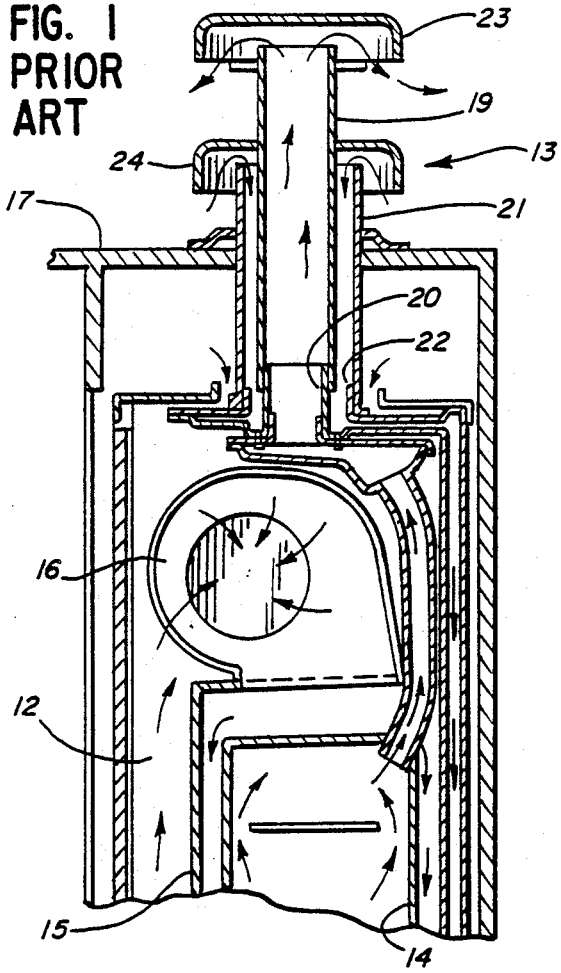
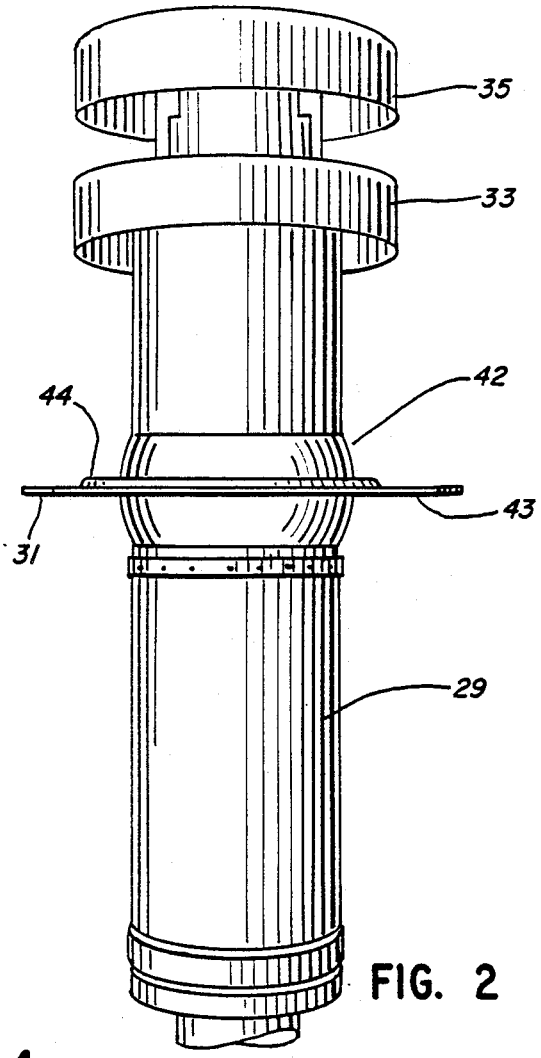
FIG. 2
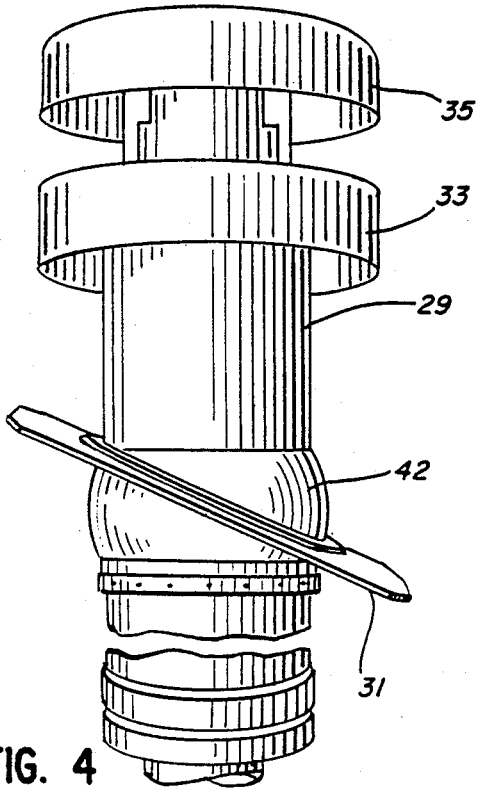
FIG. 4
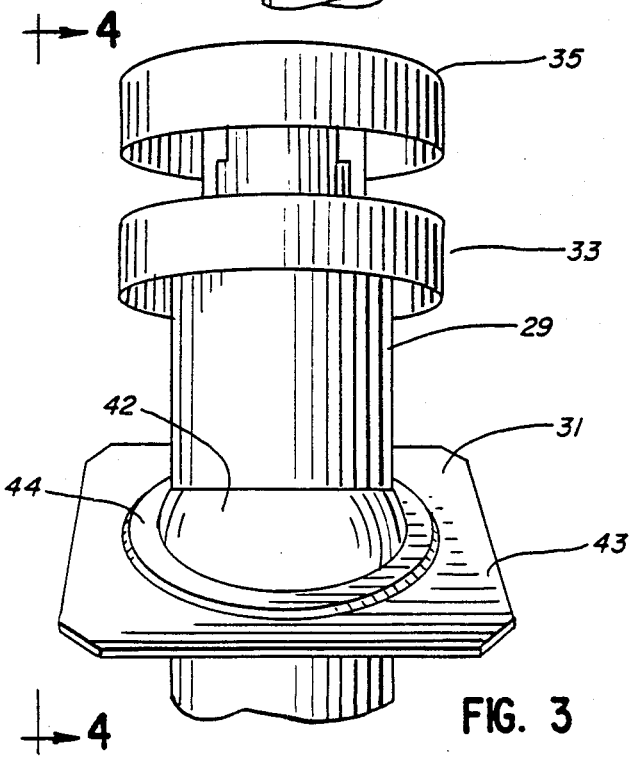
FIG. 3

FURNACE ROOF JACK WITH PIVOTING FLASHING PLATE

BACKGROUND

This invention relates to furnace roof jacks, and, more particularly, to a furnace roof jack which is provided with a pivoting flashing plate.

Sealed combustion forced air furnaces conventionally use of roof jack assembly for supplying combustion air and for exhausting flue gases. The roof jack assembly extends upwardly from the furnace through the roof of the dwelling and includes an inner tube for exhausting flue gases and an outer tube for supplying outside air for combustion.

Sealed combustion furnaces are commonly used in mobile homes or manufactured housing. Mobile homes are usually provided with a very tight, sealed construction, and all of the air for combustion in the furnace must be obtained from outside the home.

Conventional roof jacks consist of two concentric tubes. The inner tube provides a passage for flue gases to the outside, and the outer tube provides a path for combustion air from the outside to the furnace burner. The upper ends of the inner and outer tubes terminate above the roof line of the home and are protected by rain caps.

In the conventional manufactured housing application, the roof is relatively horizontal and a roof flashing or rain plate is welded to the outside of the jack in a plane which is perpendicular to the axis of the jack. Sealant is applied to the lower face of the flange, and the jack is inserted through a suitably sized hole in the roof until the flashing contacts the roof surface. The lower end of the jack is pulled down and attached to the furnace top, and sheet metal screws are driven through the flange into the roof to complete the installation. The flashing is supported by the roof and supports the upper section of the jack.

In the case of homes with pitched roofs, a wedge shaped spacer of suitable dimensions must be installed between the roof flashing and the roof to allow proper installation. The extra part adds to cost, increases the number of joints which must be sealed against the weather, and requires stocking of various wedge sizes and pitches to accommodate the various possible roof pitches.

SUMMARY OF THE INVENTION

The invention provides a roof jack with a pivoting flashing plate. The flashing plate is pivotally attached to the roof jack by rivets which extend perpendicularly to the axis of the jack. The connection between the flashing plate and the jack is sufficient to support the upper section of the jack when the flashing is supported by the roof. The flashing can pivot to accommodate pitched roofs within a range of angles, and no extra parts are needed to complete the installation.

DESCRIPTION OF THE DRAWING

The invention will be explained in conjunction with illustrative embodiments shown in the accompanying drawing, in which FIG. 1 is a fragmentary sectional view of a prior art sealed combustion forced air furnace and roof jack assembly, FIG. 2 is a perspective view, partially broken away, of a roof jack assembly formed in accordance with the invention;

FIG. 3 is a view similar to FIG. 2 showing the flashing plate in an angled position;

FIG. 4 is a side view taken along the line 4—4 of FIG. 3;

DESCRIPTION OF SPECIFIC EMBODIMENTS

Figure 5:
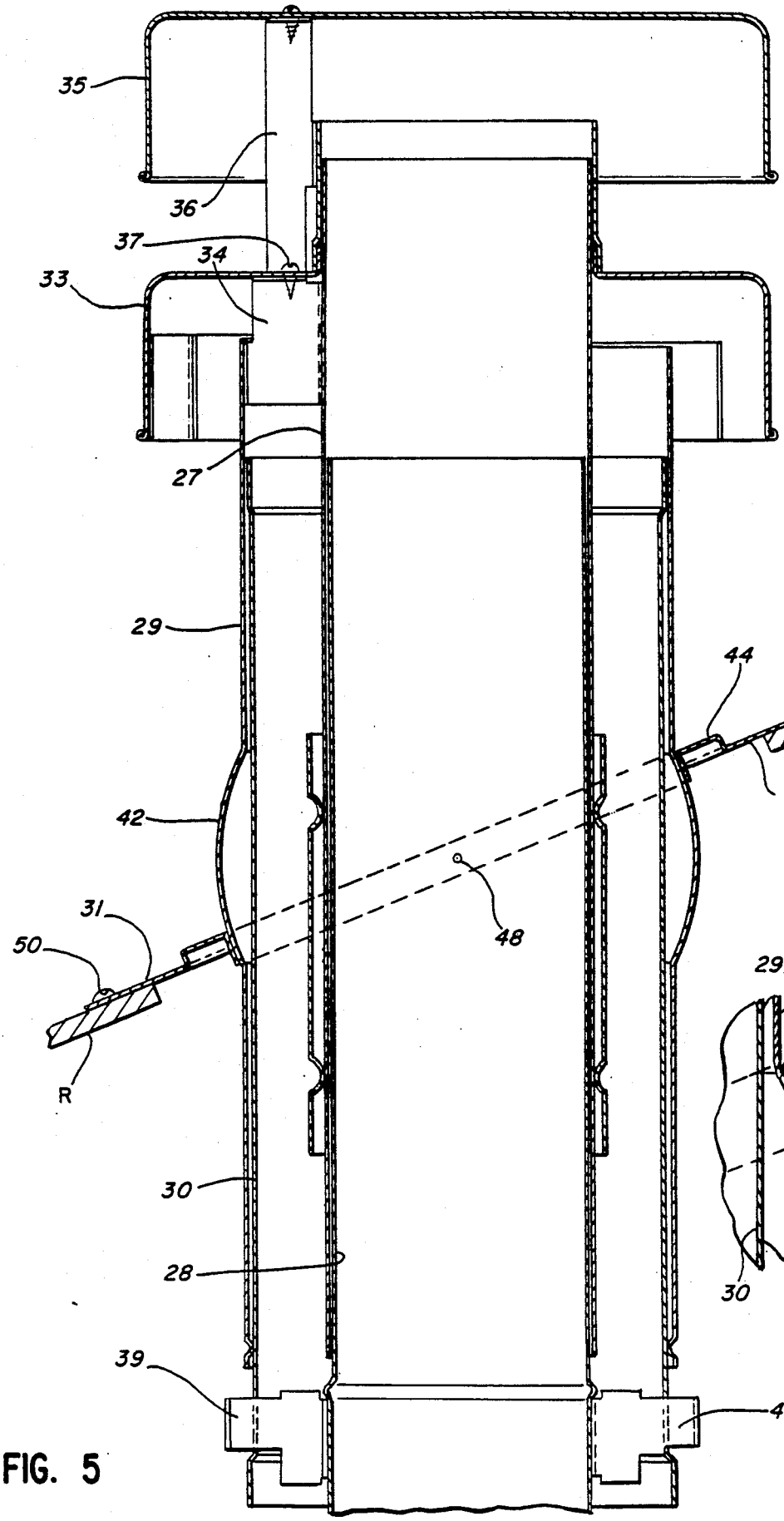
FIG. 5 is a fragmentary sectional view of the roof jack assembly.

FIG. 1 illustrates a prior art sealed combustion forced air furnace 12 and roof jack assembly 13. The details of the furnace and roof jack assembly are described in U.S. Pat. Nos. 3,614,949, 3,656,470, and 3,685,577.

The next furnace 12 includes a combustion chamber 14, a heat exchanger chamber 15, and a centrifugal air blower 16. The air blower draws room air into the heat exchanger and forces it past the combustion chamber and through hot air ducts back to the rooms.

The roof jack assembly 13 extends through the ceiling 17 of the mobile home or other dwelling and provides outside combustion air to the combustion chamber and conveys products of combustion and flue gases to the outside. The roof jack assembly includes an inner flue tube 19 which connects to a flue outlet pipe 20 of the furnace and an outer air inlet tube 21 which connects to an air inlet pipe 22 to the furnace. The upper ends of the flue tube and air inlet tube are protected by rain caps 23 and 24, respectively.

The operation of the roof jack assembly 13 and the furnace 12 is well known to those skilled in the art and is explained in detail in the aforementioned United States patents.

FIGS. 2–6 illustrate a roof jack assembly 26 formed in accordance with the invention. The particular roof jack assembly 26 illustrated is a telescoping roof jack. The details of the telescoping feature are described in U.S. Pat. No. 4,522,191. It will be understood, however, that the invention is also applicable to non-telescoping roof jacks.

The roof jack assembly 26 includes a pair of inner telescoping tubes 27 and 28 (FIG. 5) and a pair of outer telescoping tubes 29 and 30. The outer tube 29 is fixed to the roof of the dwelling by a flashing plate 31. The outer tube 29 is therefore stationary with respect to the roof, and the other outer tube 30 telescopes within the stationary tube 29.

The inner tube 27 is also stationary with respect to the roof. A rain cap 33 is mounted above the outer tube 29 by three circumferentially spaced brackets 34 which are spot welded to the stationary outer tube 29 and to the stationary inner tube 27. A rain cap 35 is mounted above the stationary inner tube 27 by three brackets 36 which are attached to the rain cap 33 and to the brackets 34 by screws 37.

The telescoping inner tube 28 and the telescoping outer tube 30 are connected together so that they telescope simultaneously by two diametrically opposed connecting straps 39 and 40. The telescoping tubes 28 and 30 are pulled downwardly from the stationary tubes 27 and 29 in order to accommodate the spacing between the ceiling of the dwelling and the flue outlet collar and the combustion air inlet collar of the furnace (see 20 and 22 in FIG. 1).

The telescoping flue tube 28 slides snugly within the stationary flue tube 27, and the flue tubes 27 and 28 provide a sealed path for flue gases which flow upwardly through the tubes 27 and 28 and through the space between the rain cap 36 and the upper end of the tube 27. The tubes 29 and 30 provide a sealed flow path for outside combustion air which flows through the space between the rain cap 33 and the upper end of the stationary tube 22.

Figure 6:
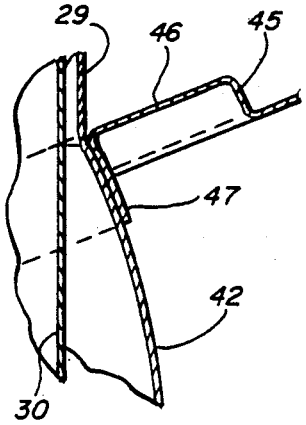
FIG. 6 is an enlarged fragmentary sectional view of a portion of FIG. 5.
Figure 9:
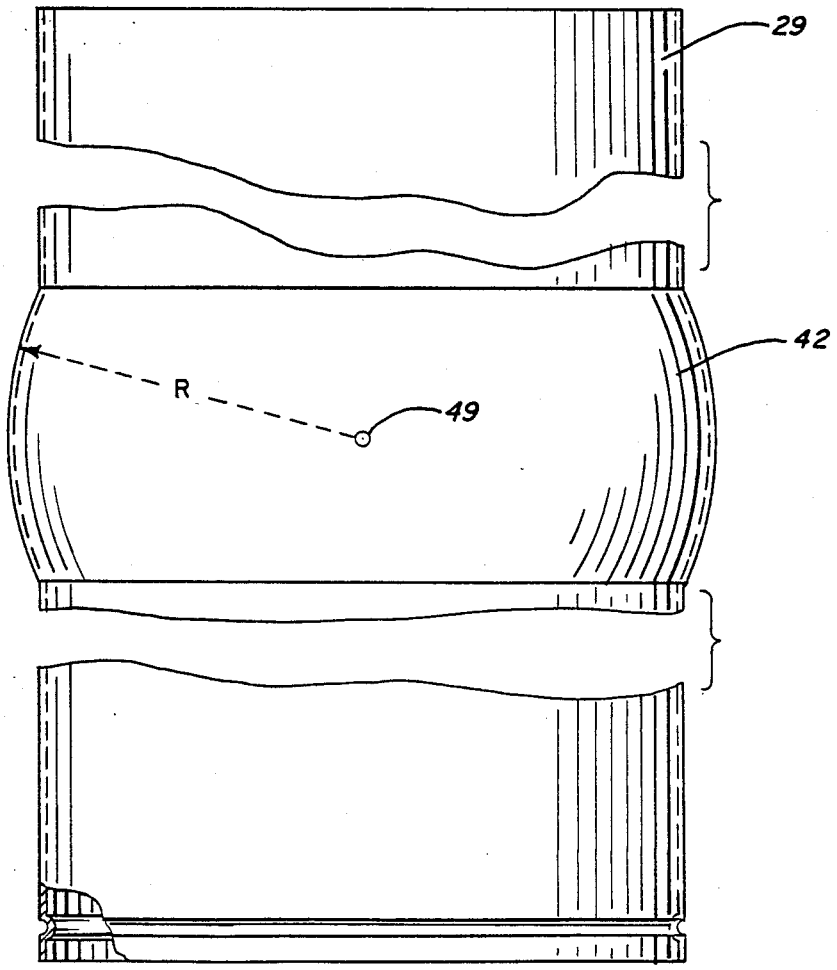
FIG. 9 is an enlarged fragmentary view of the outer tube.

The enlarged portion 42 of the outer tube 29 to which the flashing plate 31 is attached has a generally spherical outer surface having a radius R (FIG. 9). The flashing plate includes a flat outer portion 43 and an annular inner portion 44 which is generally channel-shaped in cross section. Referring to FIG. 6, the annular inner portion 44 includes a generally cylindrical outer wall 45 which extends upwardly from the flat portion 43, a flat top wall 46, and a generally cylindrical inner wall 47 which provides a circular opening through which the outer tube 29 extends. The inner wall 47 is advantageously curved to mate with the curvature of the spherical portion 42 of the outer tube 29. The diameter of the inner wall 47 is just slightly larger than the diameter of the spherical portion 42 so that the inner wall can pivot smoothly yet snugly over the spherical portion 42.

The flashing plate 31 is pivotally attached to the outer tube 29 by a pair of diametrically opposed pop rivets 48 or equivalent fasteners. The pivoting axis provided by the rivets extends along a diameter of the spherical portion 42 perpendicular to the centerline or axis CL of the outer tube 29. The outer tube is provided with rivet holes 49 (FIG. 9) to accommodate the rivets.

The flashing plate can pivot on the rivets 48 until the flat outer portion 43 is flush with the roof R (FIG. 5). The flashing plate is then fastened to the roof by sheet metal screws 50. If desired, silicone sealant or other sealing material can be used to seal the space between the outer tube 29 and the flashing plate.

Figure 7:
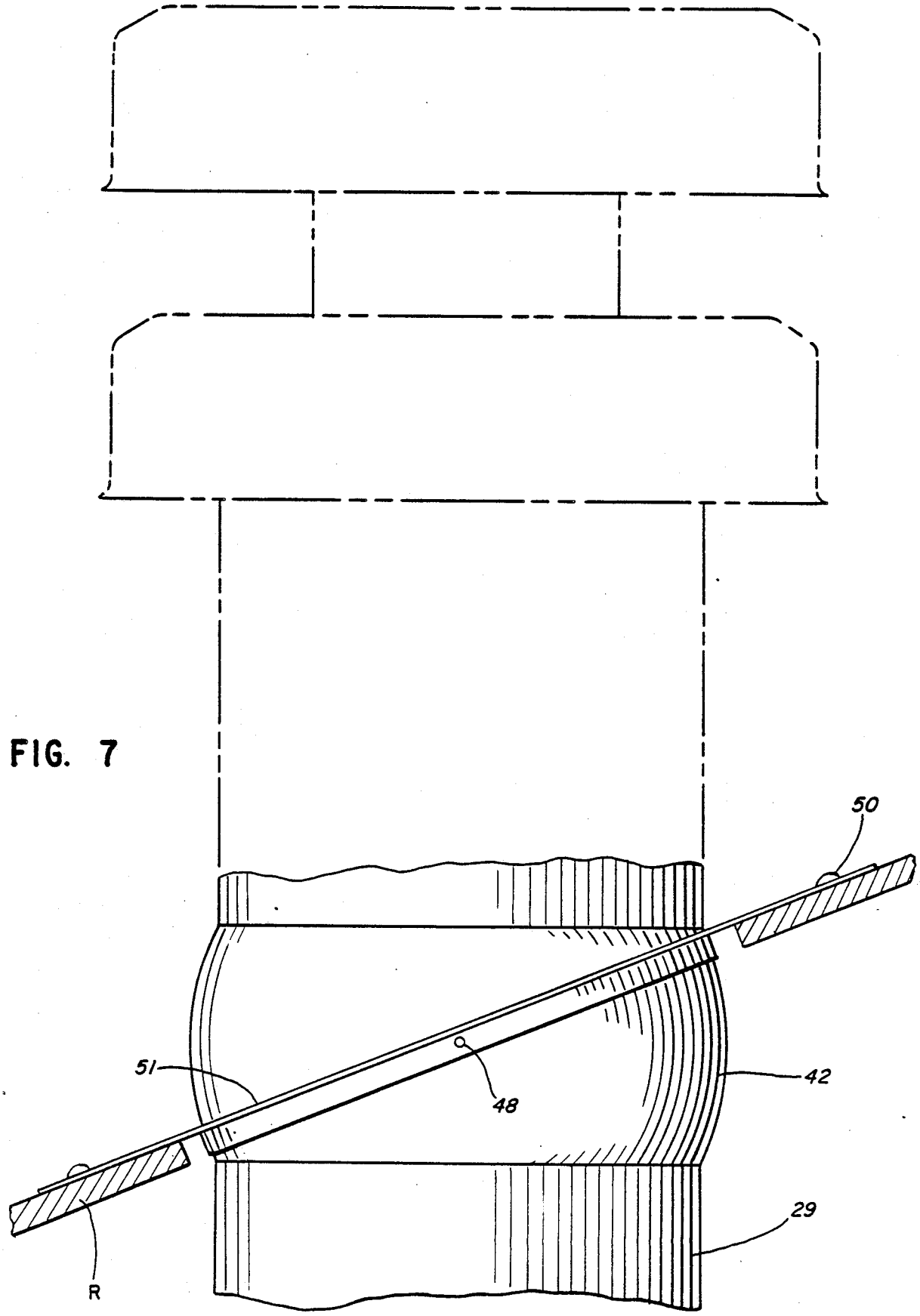
FIG. 7 is a fragmentary sectional view showing a modified flashing plate.
Figure 8:
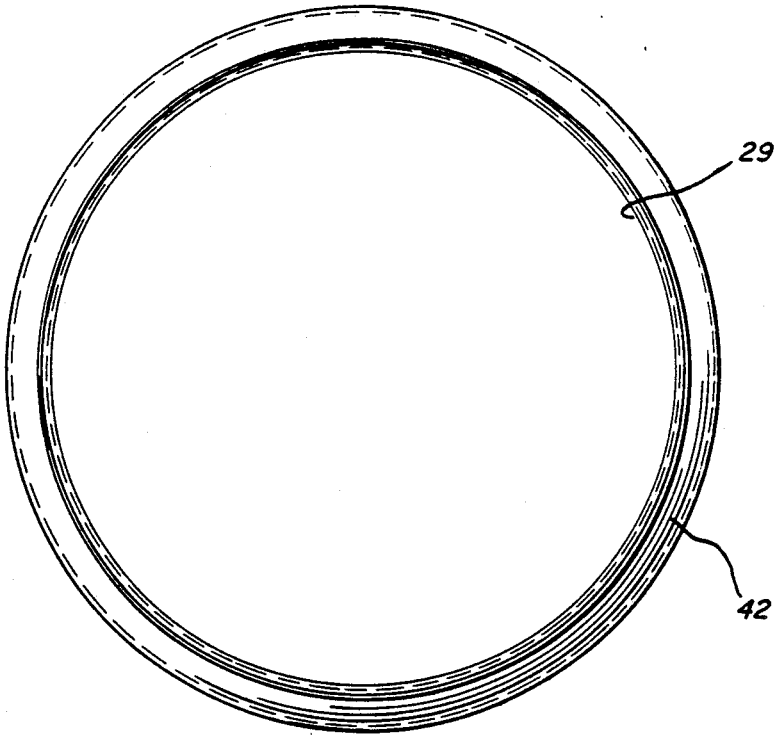
FIG. 8 is a top view of the outer tube of the roof jack.

FIG. 7 illustrates a modified flashing plate 51 which includes a flat plate 52 and a cylindrical flange 53 which extends generally perpendicularly to the plate. The flange is advantageously curved to mate with the spherical surface 42 of the outer tube.

In the preferred embodiment of the invention, the outer tube of the roof jack includes the enlarged spherical portion 42 so that a relatively snug fit between the tube and the flashing plate is maintained as the flashing plate pivots. However, if the tube is cylindrical, the opening in the flashing plate could be oval to permit the flashing to pivot relative to the tube. After the flashing plate is secured to the roof, any space between the tube and flashing plate could be sealed by a rubber boot or sleeve, by silicone sealant, etc.

Although the weight of the telescoping tubes 28 and 30 are supported by the furnace, the weight of the upper section of the roof jack, including the stationary tubes 27 and 29 and the rain caps 33 and 35, must be supported by the flashing plate. The connection between the flashing plate and the outer tube provides sufficient structural support for the upper section of the roof jack while still allowing pivoting movement of the flashing plate.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A tube assembly for communicating a burner, with the outside of a dwelling through the roof of a dwelling comprising an elongated cylindrical tube adapted to be attached to the burner, and a substantially flat flashing plate having an opening through which the tube extends, the flashing plate engaging the tube and being pivotally attached to the tube for pivoting movement about an axis which extends perpendicularly to the axis of the tube, whereby the tube can extend through an opening in the roof of the dwelling and the flashing plate can be secured to the roof.

2. The structure of claim 1 in which the flashing plate is pivotally secured to the tube by rivets.

3. The structure of claim 1 in which the tube includes an enlarged portion having a generally spherical surface, the opening in the flashing plate having a diameter approximately the same as the outside diameter of the spherical surface of the tube, the pivot axis of the flashing plate extending along a diameter of the spherical surface.

4. The structure of claim 3 including a generally cylindrical flange on the flashing plate which extends generally perpendicularly to the flashing plate and which has a curved surface which mates with said spherical surface.

5. The structure of claim 3 in which the flashing plate is pivotally secured to the tube by rivets.

6. A roof jack assembly for a furnace comprising an elongated inner tube and an elongated, generally cylindrical outer tube surroundings the inner tube, and a substantially flat flashing plate having an opening through which the outer tube extends, the flashing plate engaging the tube and being pivotally attached to the outer tube for pivoting movement about an axis which extends perpendicularly to the axis of the outer tube, whereby the outer tube can extend through an opening in the roof of the dwelling and the flashing plate can be secured to the roof.

7. The structure of claim 6 in which the outer tube includes an enlarged portion having a generally spherical surface, the opening in the flashing plate having a diameter approximately the same as the outside diameter of the spherical surface of the outer tube, the pivot axis of the flashing plate extending along a diameter of the spherical surface.

8. The structure of claim 7 including a generally cylindrical flange on the flashing plate which extends generally perpendicularly to the flashing plate and which has a curved surface which mates with said spherical surface.

9. The structure of claim 7 in which the flashing plate is pivotally secured to the tube by rivets.

* * * * *